United States Patent [19]

Sable

[11] 3,942,824

[45] Mar. 9, 1976

[54] WELL TOOL PROTECTOR

[76] Inventor: Donald E. Sable, 4413 Windsor Parkway, Dallas, Tex. 75205

[22] Filed: Nov. 12, 1973

[21] Appl. No.: 414,737

[52] U.S. Cl. ..... 285/45; 285/333; 285/DIG. 9; 308/4 A

[51] Int. Cl.[2] ..... F16L 57/00

[58] Field of Search ..... 285/45, DIG. 9, 333, 334; 308/4 A; 403/344

[56] References Cited

UNITED STATES PATENTS

| | | | |
|---|---|---|---|
| 2,002,893 | 5/1935 | Holt et al. | 308/4 A |
| 2,546,295 | 3/1951 | Boice | 308/4 A |
| 2,715,552 | 8/1955 | Lane | 308/4 A |
| 3,268,275 | 8/1966 | Laughlin | 308/4 A |
| 3,425,757 | 2/1969 | Minor | 403/344 X |

*Primary Examiner*—Thomas F. Callaghan
*Attorney, Agent, or Firm*—Walter J. Jagmin

[57] ABSTRACT

A protector for well tools such as drill pipe tubing, and the like, which is positionable about a joint of a drill pipe or tubing and which is moved into predetermined position on the box-half of a tool joint by the pin-half of the tool joint as it is moved into telescoped and threaded engagement with the box-half.

14 Claims, 17 Drawing Figures

WELL TOOL PROTECTOR

This invention relates to well tool protectors and more particularly to a protector positionable on one of the enlarged box or pin halves of a tool joint.

In well operations involving the movement of an elongate member, such as a string of drill pipe or tubing, in another elongate member, such as well casing, it is necessary and desirable to protect each such member against damage due to wear between the two members. For example, during well drilling operations a string of drill pipe having a drill bit at its bottom end is lowered through the well casing and rotated. The string of drill pipe is formed of sections or pipes each having a box-half of a tool joint at its upper end and a pin-half of a tool joint at its lower end, with adjacent ends of adjacent drill pipe sections connected by the threading of the pin-half of the upper drill pipe in the box-half of the lower drill pipe. During the drilling operation the enlarged tool joint halves of the drill string tend to engage the casing in the portions of the well bore provided with the casing and the earth formation in the portions of the well bore not provided with casing. As a result, the tool joint halves wear away and when their external diameter decreases to a set lower limit, the drill pipes must be discarded. In addition, the contact of the drill pipe with the well casing, especially at locations where the well bore departs from the vertical, causes wear of the casing.

In order to minimize wear of the tool joints, in some cases the box halves of the tool joints have been provided with external bands of a metal much harder than the drill pipe itself. These "hard bands," while protecting the tool joints, increase the wear and damage to the casing. In other cases, centralizers are positioned on the drill pipe between the tool joint halves. These centralizers necessarily have a large mass and must have external diameters substantially greater than the external diameters of the tool joints to prevent contact of the tool joints with the casing. Some of such centralizers are hinged and employ hardened connector pins. In the event that any such centralizer or protector is damaged and torn off the drill pipe, it falls to the bottom of the well bore and must be removed preferably by grinding it into small pieces for removal by the usual circulation of the drilling fluids. Such removal is of course made difficult if the mass or bulk of the centralizer is relatively great or if it includes hard metal.

It is therefore desirable that a protector be provided which is of relatively small mass or bulk, which is very rigidly securable to the drill pipe, and which does not include any materials which are hard to grind or drill.

Accordingly, it is an object of this invention to provide a well tool protector mountable on the well tool, such as a string of drill pipe, which is of small mass or bulk, which prevents contact of the well tool with the well casing, and which does not have hardened parts which are difficult to grind or comminute.

Another object is to provide a protector having a cylindrical mandrel of greater diameter than the external diameter of the box-half of a tool joint and resilient compressible means secured to the mandrel and compressed about the box-half to secure the mandrel to the box-half, the mandrel having resilient outer covering or sleeve secured thereto.

A further object is to provide a protector, of the type described, wherein the internal diameter of the protector is smaller than the external diameter of the box-half of a tool joint whereby compression means of the protector are expanded and compressed as the protector is telescoped over the box-half to secure the protector to the box-half.

Another object is to provide a protector, of the type described, which is positionable on conventional tool joints of a drill pipe of tubing without requiring adaptation or modification of the tool joint.

A still further object is to provided a protector, of the type described, having an internal substantially cylindrical expander member engageable by the pin-half of the tool joint for forceably moving the protector downwardly onto the box-half during the connection of the pin-half to the box-half of the joint, resilient compression means being disposed between the expander and the mandrel.

An important object of the invention is to provide a tool joint protector having a cylindrical mandrel of greater internal diameter than the external diameter of the box-half of a tool joint which is provided externally with a resilient protective sleeve and internally with resilient means bonded to the internal surface of the mandrel and compressible between the box-half of the joint and the mandrel as the protector is telescoped over the box-half to secure the protector on the box-half.

Another object is to provide a protector, of the type described, wherein the internal resilient means are in the form of longitudinal circumferentially spaced compressing members which expand laterally between the box-half and the mandrel as the protector is telescoped over the box-half and the compression members are compressed between the box-half and the mandrel.

Still another object is to provide a protector, of the type described, wherein the mandrel is provided with longitudinally spaced apertures at the locations of the compression members and the external resilient sleeve and the compression members are connected by the resilient substance of which they are formed whereby any excess substance of the compression members may flow outwardly through the apertures as the protector telescopes over a box-half.

Another important object of the invention is to provide a drill pipe protector having an internal cylindrical member whose internal diameter is substantially equal to the external diameter of the tool joint and wherein the mandrel and the internal member have resilient compression means disposed therebetween which are compressed between the mandrel and the internal member and into engagement with the external surface of the box-half of the tool joints through apertures of the internal member.

Another important object is to provide a protector having a mandrel and internal compressible resilient means which are compressed between the mandrel and the box-half of a tool joint to resist rotational movement of the protector on the box-half.

Additional objects and advantages of the invention will be readily apparent from the reading of the following description of a device constructed in accordance with the invention, and reference to the accompanying drawings thereof, wherein.

Figure 1:
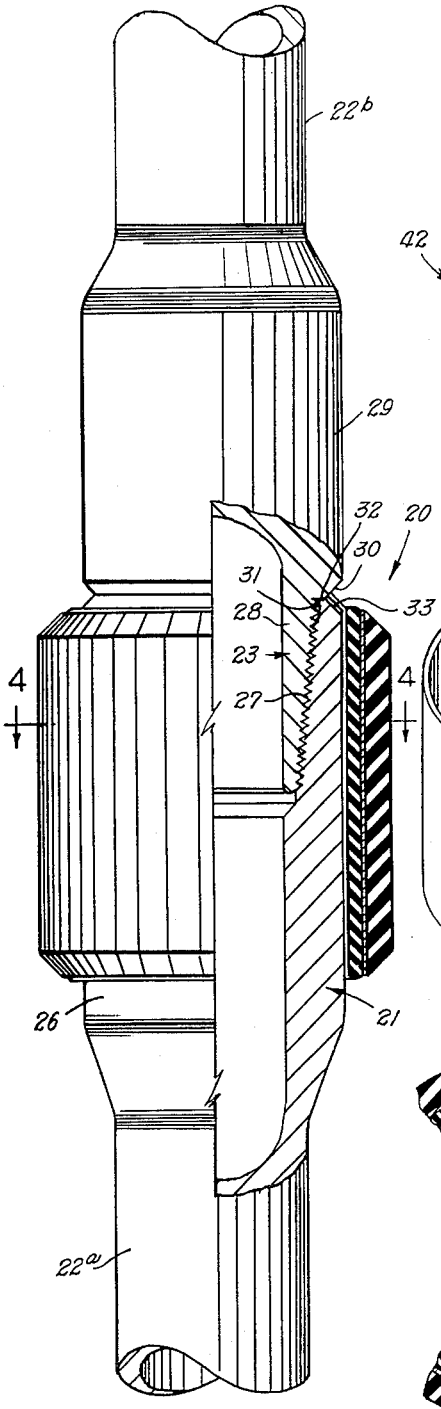
FIG. 1 is a vertical partly sectional view of a drill pipe protector shown in position on the box-half of a tool joint of the drill pipe.
Figure 5:
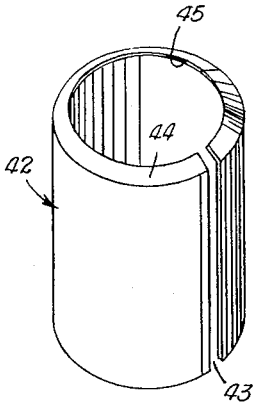
FIG. 5 is a perspective view of an internal expander member of the protector.
Figure 2:
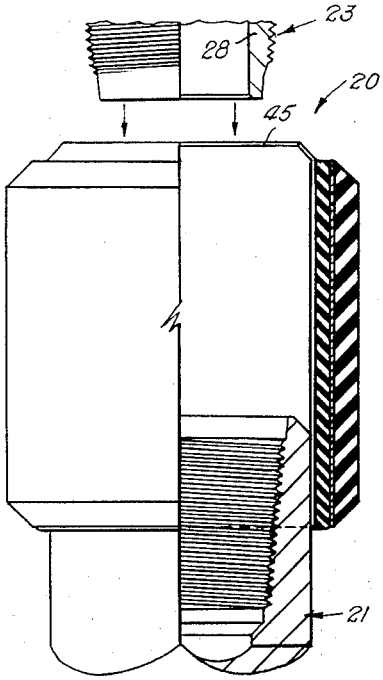
FIG. 2 is a vertical, partly sectional view showing an initial stage in the positioning of the drill pipe protector on the box-half of the tool joint.
Figure 6:
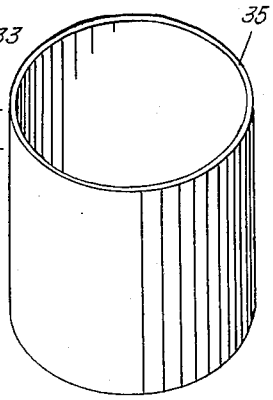
FIG. 6 is a perspective view of the mandrel.
Figure 3:
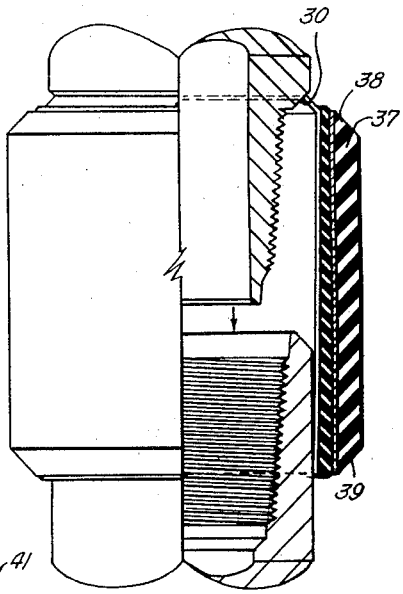
FIG. 3 is a view similar to FIG. 2 showing the manner in which the pin-half of the tool joint forcibly moves the protector downwardly over the box-half as the pin-half is moved downwardly into telescoped threaded engagement with the box-half.
Figure 4:
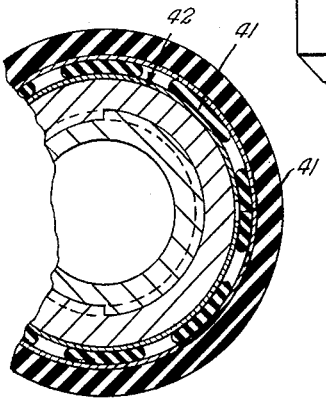
FIG. 4 is a fragmentary sectional view taken on line 4—4 of FIG. 1.

Referring now particularly to FIGS. 1 through 4 of the drawings, a tool joint protector 20 embodying the invention is shown in position on the box-half 21 at the upper end of a lower section 22*a* of the drill pipe. The bottom end of each section of the drill pipe has a pin-half 23 of the tool joint 24 formed of the box and pin halves of adjacent pipe sections. The box-half of the joint includes the externally enlarged top end portion 26 of a drill pipe section, the bore of which at its top portion is enlarged and internally threaded, as at 27, to receive the externally reduced threaded end portion 28 of the pin-half at the bottom of the adjacent upper pipe section 22*b*. The pin-half of the joint includes the externally enlarged portion 29 which provides an inwardly and downwardly inclined or bevelled annular surface 30 and a downwardly facing seal surface 31 which engages the annular top end seal surface 32 of the box-half 21. The top end of the box-half of the joint has an upwardly and inwardly inclined or bevelled shoulder 33.

The drill pipe protector includes a cylindrical mandrel 35, of a steel or the like, having an internal diameter which is considerably greater than the external diameter of the enlarged upper end portion 26 of the box-half 21. The mandrel 35 has bonded or molded thereto an outer resilient sleeve 37 which is substantially tubular in form and has upper and lower outwardly convergent end surfaces 38 and 39.

The mandrel, at its inner surface, has a plurality of longitudinally extending resilient spaced compression members 41 bonded thereto and to a cylindrical expander 42 to which the compression members are also bonded or molded. The expander 42 inherently has an internal diameter which is smaller than the external diameter of the enlarged portion 26 of the box-half 21 and is split as at 43 to permit its resilient radial expansion.

The expander 42 at its upper end is provided with an inwardly and upwardly extending flange 44 whose inner cam surface or edge 45 is of smaller diameter than the diameter of the enlarged portion 29 of the pin head 23 so that the camming engagement of the cam surface 45 with the surface 30, as the upper drill pipe section 22*b* moves downwardly relative to the protector 20, causing expansion of the expansion member 42 and its radial compression against the resistance of the compression members 41 which deform as required to permit telescoping movement of the protector over the box-half 21 of the joint 24.

In use, the drill pipe protectors 20 are installed at each joint 24 or connection of adjacent ends of the drill pipe sections 22 or at selectively spaced joints of the drill pipe string, for example, at every other joint.

The protectors 20 are secured to the joints at the time of the making up of the string of the drill pipe in the usual manner, wherein the uppermost section 22*a* of the string is supported and held against rotation by the usual means of the drill rig.

The protector 20 is then partially telescoped over the box-half 21 or at least the expander member 42 is centered on the shoulder 33 of the box-half. As the next section 22*b* is then lowered downwardly and before the reduced pin section 28 telescopes fully into the box-half 21, the shoulder 30 of the pin-half engages the shoulder 45 of the expander so that continued downward movement of the pipe section 22*b* now simultaneously causes downward movement of the protector 20. In addition, the camming engagement between the surfaces 45 and 30 tends to expand the expander against the resistance of the compression members which deform as they are compressed so that such expansion of the expander is resisted by the compression members. As the pin-half of the joint moves into the box-half of the joint 21, the upper pipe sections is rotated by the usual spinning chain in an appropriate direction to cause the reduced section 28 of the pin-half to be threaded in the enlarged bore portion 27 of the box-half. As the upper section 22*b*, which is supported by 2 rotary block, is caused to spin, downward movement of the pin-half relative to the box-half of the joint, and, therefore downward movement of the protector on the box-half, continues until the protector is in the position illustrated in FIG. 1. Upward movement of the protector is now prevented due to the engagement of the shoulder 45 with the shoulder 30 since further expansion of the expansion member 42 is now resisted by the compression members 41 and downward movement of the assembly is prevented by the engagement of the flange 44 with the shoulder 33 of the box-half. The sleeve 37 will now prevent contact of the enlarged portions 29 and 26 of the joint halves 21 and 23 with the bore wall.

It will be apparent that no special tools are needed to position or drive the protector over the box-half of the joint, this being accomplished by the weight of the upper drill pipe section 22*b* and the Kelly which is connected to the top end of the drill pipe section 22*b*, as it is lowered while the lower section 22*a* is held against downward movement.

It will be apparent that not only does the protector prevent contact of the drill pipe with the well bore, but also serves as a shock absorber since both the outer sleeve 37 and the compression members are resilient.

The protector may of course be easily removed from the joint after the outer protector sleeve 37 has worn or abraded by positioning a suitable tool below the bottom edge of the expansion member and the mandrel, after the top section 22*b* has been disconnected from the section 22*a*, and then applying an upward force to such tool to move the protector upwardly off the box-half.

It will now be seen that a new and improved protector for a drill pipe has been illustrated and described which is easily positionable on the usual joint 24 of commercially available drill pipes at the time the two pipe sections are connected without the necessity of modifying the drill pipe sections and without the use of special tools and employing only the weight of the upper pipe section to fixedly secure the protector on the box-half of the joint.

It will further be seen that the protector once in place is held against vertical movement on the box-half of the joint and also against rotatable movement thereon.

The mandrel and the expander are made of mild steel while the compression members are of a suitable resilient substance having approximately 85 durometer hardness. As a result, should the protector be forced off the string of drill pipe during operations and fall to the bottom of the well bore, it may easily be comminuted by the drill bit or special grinding tool and removed from the well by the usual circulating drilling fluids. This comminution and removal are facilitated since the mass or bulk of the protector is relatively small because it is positioned on the enlarged tool joint itself.

Referring now particularly to FIGS. 7 through 12 of the drawings, the drill pipe protector 120, of preferred form, is similar to the protector 20 and accordingly, its elements have been provided with the same reference numerals, to which the prefix 1 has been added, as the corresponding elements of the protector 20.

The protector 120 differs from the protector 20 in that it is not provided with an expander 42 and the vertical compression members 141 directly engage the outer surface of the enlarged portion 26 of the box-half 21. To facilitate the telescopical movement of the protector onto the box-half 21, the compression members are provided with upwardly inclined downwardly facing cam shoulders 150 which are adapted to engage the bevelled cam shoulder 33 of the box-half 23. The inner surfaces of the compressor members 141 lie in a cylindrical plane of smaller diameter than the external diameter of the enlarged portion 26 of the box-half so that they are compressed between the outer surface of the large portion 26 of the box-half 21 due to the engagement of the shoulder 145 of the mandrel with the shoulder 30 of the pin-half of the joint 24.

While only four compression members 141 have been shown for ease and clarity of illustration, in actual practice the compression members are of very smaller width and as many as thirty or more in number.

The mandrel at the location of each compression member may be provided with a plurality of longitudinally aligned and spaced apertures 155 so the compression members and the resilient sleeve 137 are connected to one another through the apertures to provide fro greater mechanical connection of the compression members and the sleeve to the mandrel and to provide for some radial outward displacement of the substance of which the compression members are formed during the telescoping of the protector on the box-half.

The top ends 156 of the compression members are spaced below the bottom edge of the inwardly and upwardly inclined annular flange 157 of the mandrel 135 so that the substance of which the compression members are formed may flow or be displaced upwardly in the mandrel during the installation of the protector on a box-half, without engaging the flange 157 or flowing inwardly between the flange 157 and the shoulder 33 of the box-half. Were some of the substance to flow between the shoulder 33 and the flange 157, the flange would tend to bend inwardly and could move between the seat surfaces 31 and 32 of the tool joint halves thus preventing effectuation of a proper seal therebetween.

It will be apparent that the protector 120 is installed on the box-half 23 of a tool joint 24 in the same manner as the protector 20, the weight of the upper section 22b of the drill pipe forcing the protector downwardly, the compressor members being compressed radially against the mandrel and thereafter the mandrel is held against upward movement due to the engagement of its flange 157 with the shoulder 30 of the pin-half of the joint and against downward movement due to the engagement of the flange with the shoulder 33 of the box-half 23 of the joint.

It will be apparent that during the installation, the protector is placed on the box-half joint 23 with the shoulders 150 of the compressor members 141 resting upon the shoulder 33 of the box-half joint so that as the shoulder 30 of the pin-half engages the flange 157 during the downward movement of the upper section 22b of the drill pipe into the lower section 22a, the camming engagement of the shoulders 150 and 33 will tend to facilitate radial compression of the compressor members and help center the protector 120 on the box-half 21 at the time of initial downward telescopical movement thereof over the box-half.

To facilitate such telescopical movement of the protector over the box-half, a suitable lubricant, such as soapy water, may be employed.

As the protector telescopes downwardly on the box-half 21, the compression members are compressed between the box-half and the mandrel 35, the compression members expand laternally or circumferentially relative to the box-half and the mandrel. The resilient substance of which the compression members are formed, if the apertures 155 are provided in the mandrel, tends to flow under pressure and the provision of the apertures 155 permits radial outward flow thereof through the apertures thus limiting compressional forces.

Figure 7:
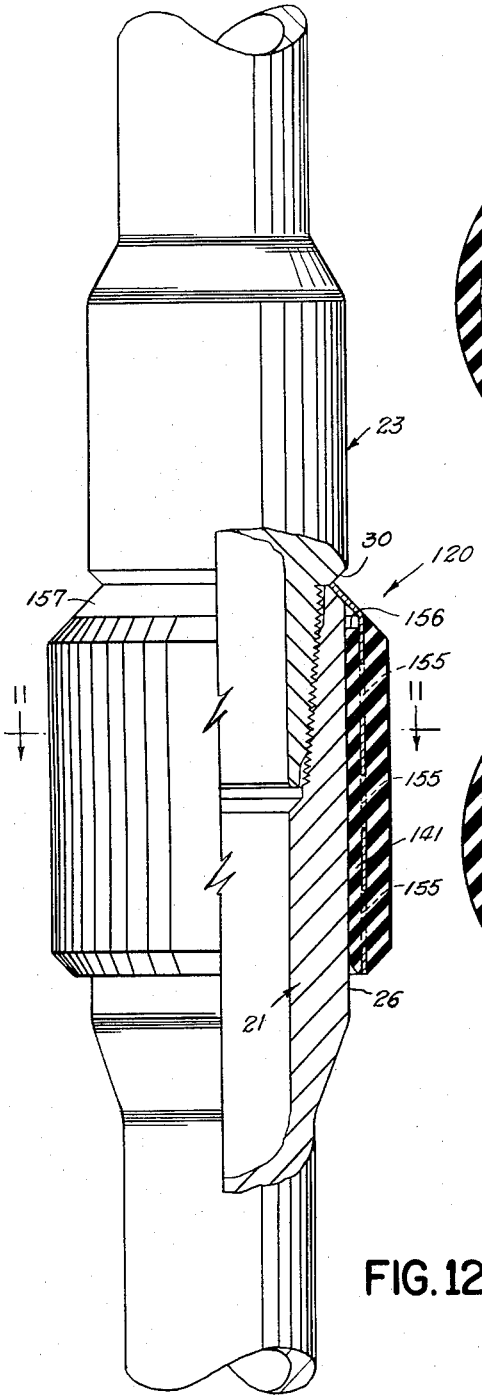
FIG. 7 is a vertical, partly sectional view of a preferred form of a tool joint protector embodying the invention shown in position on the box-half of a tool joint.
Figure 10:
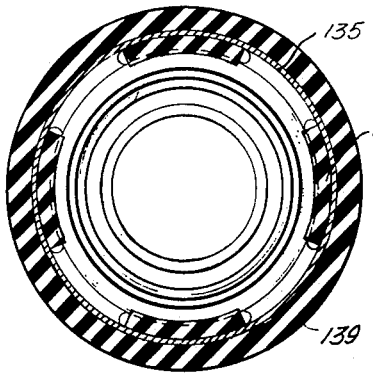
FIG. 10 is a sectional view taken on line 10—10 of FIG. 8.
Figure 11:
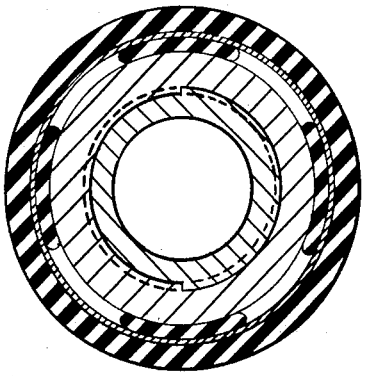
FIG. 11 is a sectional view taken on line 11—11 of FIG. 7.
Figure 12:
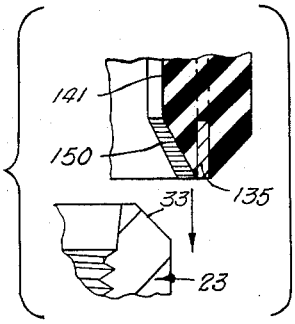
FIG. 12 is an enlarged sectional view showing the box-half of a tool joint and the protector at the initiation of the installation of the protector on the box-half.
Figure 8:
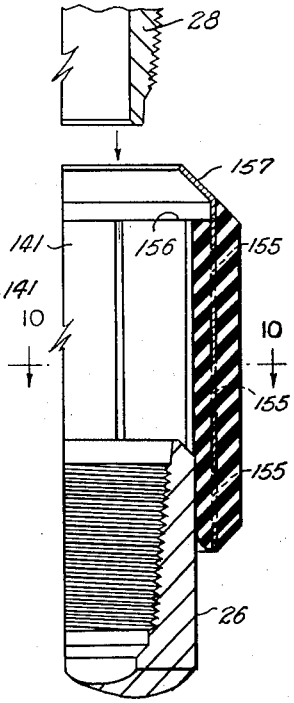
FIG. 8 is a partly sectional view showing an initial stage in the mounting of the protector of FIG. 7 on the box-half of a tool joint.
Figure 9:
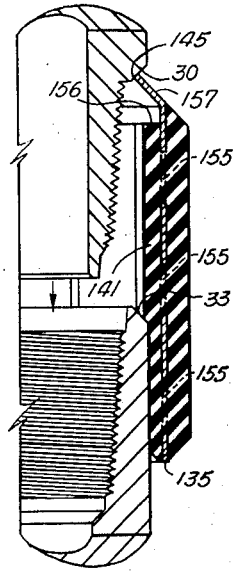
FIG. 9 is a view similar to FIG. 8 showing the manner in which the pin-half of the tool joint forcibly moves the protector onto the box-half.
Figure 13:
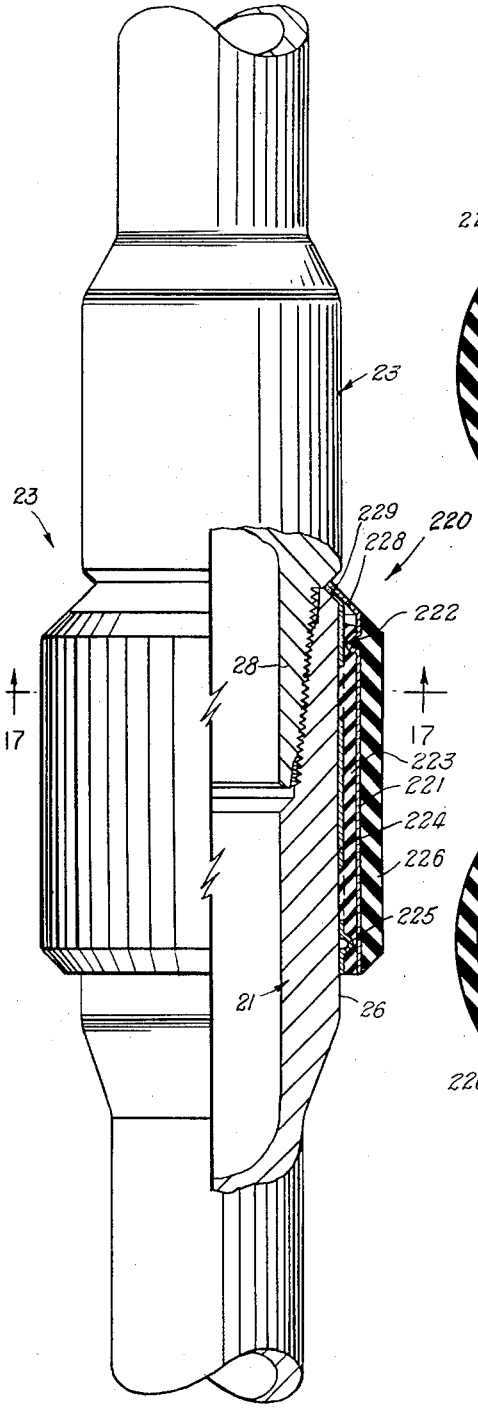
FIG. 13 is a vertical, partly sectional view of another form of the drill pipe protector embodying the invention shown in position on the box-half of a tool joint of the drill pipe.
Figure 16:
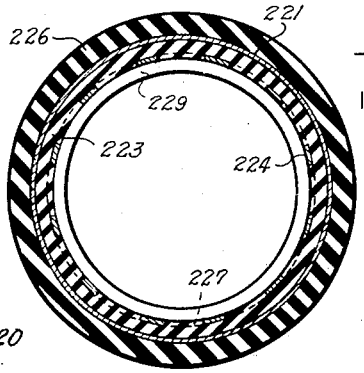
FIG. 16 is a sectional view taken on line 16—16 of FIG. 14.
Figure 14:
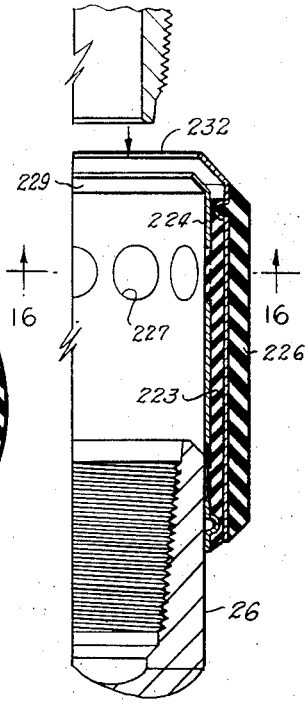
FIG. 14 is a vertical sectional view showing an initial stage in the installation of the protector of FIG. 13 on the box-half of the tool joint.
Figure 17:
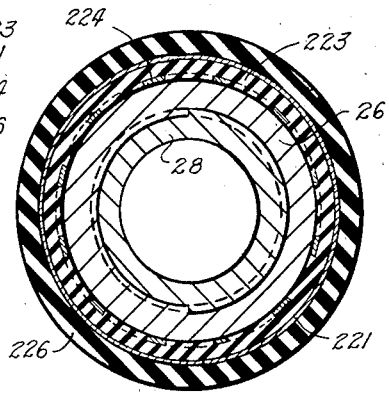
FIG. 17 is a sectional view taken on line 17—17 of FIG. 13.
Figure 15:
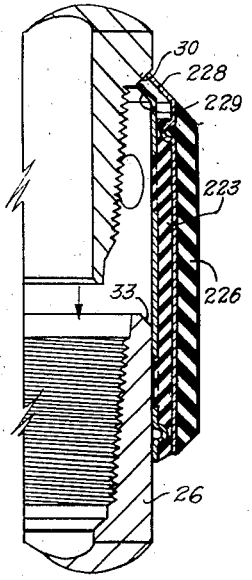
FIG. 15 is a view similar to FIG. 14 showing a second stage of the installation.

When the protector is in the operative position illustrated in FIG. 7, the flange 157 is adapted to engage any downwardly facing obstructions of the well, such as the bottom end of the well casing, to cam the drill pipe away from the location of engagement of the flange with such obstruction thus minimizing the possibility of breaking of the protector off the drill pipe. The thickness of the compressor members 141, for given characteristics of compressibility, resilience and friction of the substance of which the compressor members are formed may be so chosen that if the force tending to resist rotational movement of the centralizer relative to the box-half, as the drill pipe rotates, exceeds a predetermined value, as when the body 37 engages the earth surface defining the well bore the tool joint will rotate relative to the protector and the compression members will in effect act as a bushing relative to the box-half.

In certain operations where the body 139 if formed of a resilient substance tends to wear excessively due to the characteristics of the well bore, the body 139 may be formed of the same metal as the mandrel and be integral therewith.

Referring now to FIGS. 13 through 17 of the drawings, the protector 220 embodying the invention includes a mandrel 221 which is adjacent its upper edge and is provided an internal arcuate compression flange 222 which is embedded in an inner compression member 223, an inner sleeve or member 224 of steel or the like whose inner diameter is substantially equal or slightly greater than the external diameter of the enlarged portion 26 of the box-half 21, the inner sleeve being an external compression flange 225 adjacent its lower end which is also embedded in the compression member 223. The mandrel is, of course, provided with the outer sleeve 226 of a resilient substance and also with apertures 227. The mandrel and inner members are provided with annular inwardly and upwardly inclined flanges 228 and 229, respectively. The inner edge 232 of the flange 228 is adapted to be engaged by the shoulder 30 of the pin-half of the tool joint 224 as the upper drill pipe section **22*b* is lowered into the lower section 22*a* of the pipe while the flange 229 is adapted to engage the shoulder 33** of the box-half.

The protective sleeve 226 and the inner member 224 are of course bonded to the mandrel and inner member as by molding.

In use, the protector 220 is installed on the pin-half 21 by telescoping the protector downwardly over the enlarged portion 26 of the box-half until its downward movement is arrested due to the engagement of the flange 229 of the inner member 224 with the shoulder 33 of the box-half. Ordinarily, the protector will easily slide down over the enlarged portion 26 of the box-half since the internal diameter of the inner member 224 is equal to or very slightly greater than the external diameter of the enlarged portion 26. In the event, some force is required to move it downwardly due to the engagement of the edge surface 232 of the flange 228 of the mandrel by the shoulder 30 of the pin-half 23, a downward force will be exerted on the protector which will cause it to slide downwardly until the flange 229 engages the shoulder 33. As the pin-half is connected in the box-half, the engagement of the shoulder 30 of the pin-half with the edge surface 232 of the flange 228 of the mandrel 221 will now cause downward movement of the mandrel relative to the member 224. As a result, the compression flange 222 moves downwardly relative to the central member and the compression flange 222 and the distance between the compression flange 222 and the compression flange 225 decreases. As a result, the resilient substance of the compression member 223 is forced resiliently inwardly through the apertures 227 into engagement with the enlarged portion 26. As a result, the protector 220 will now be held against both vertical and rotational movement on the joint 24.

It will now be seen that a new and improved drill protector has been illustrated and described which in all of its forms is easily and quickly installable on the joint of a drill pipe without requiring the use of special or modified drill pipe sections or the use of special tools.

It will also be apparent that each of the three forms of the drill pipe protector is provided with a cylindrical or molded member, compression members which are compressed against the mandrel to cause a frictional engagement between the protector and one of the halves of a joint 24 of a drill pipe.

It will further be seen that while the protector has been illustrated and described in each instance as being placed on the bos-half of a tool joint 24, its longitudinal position could be reversed so that it would be positioned on the enlarged portion 29 of the pin-half of the joint.

While each form of the illustrated and described well tool protector has shown and described an external resilient sleeve which minimizes wear of the well casing at locations of engagement of the protector with the casing, it will be apparent that in applications where the protector, at locations of its use, is exposed to the open bore hold at earth formations which might quickly abrade the resilient sleeve, the sleeve could be omitted in which case the mandrel may be of thicker mild steel.

The mandrels and expanders are formed of mild steel so that the protector can be milled or cut off the tool joint by use of usual well known tools while the drill string is in the well or be easily comminuted by the drill bit if it should be forced off the drill pipe and fall to the bottom of the bore hold.

The foregoing description of the invention is explanatory only, and changes in the details of the construction illustrated may be made by those skilled in the art, within the scope of the appended claims, without departing from the spirit of the invention.

What is claimed as new and desired to be secured by Letters Patent is:

1. A protector for a well tool joint formed of a pin-half on one section of an elongate well tool having an annular external shoulder and a reduced threaded end portion and a box-half on another elongate section of the well tool having a threaded bore for receiving the reduced threaded end portion and an external annular shoulder facing the external shoulder of the pin-half when said halves are connected, said protector including: a rigid single piece cylindrical member having an internal annular flange at one end; and internal resilient compression means in said cylindrical member extending longitudinally relative to said cylindrical member at least half the length thereof and compressible against said cylindrical member when said protector is positioned on one of said joint halves, said flange being positioned between and engageable with said external shoulders of said joint halves and rotatable relative to said joint halves when said protector is positioned on said one of said joint halves for limiting longitudinal movement of said protector relative to said joint halves and permitting rotation of said protector relative thereto.

2. The protector of claim 1, and resilient means on the exterior of said cylindrical member extending radially outwardly therefrom.

3. The protector of claim 1, wherein said compression means comprise a plurality of longitudinal circumferentially spaced compression members whose diametrically opposed inner surfaces are spaced apart a distance smaller than the external diameter of said one of said joint halves.

4. The protector of claim 3, wherein said spaced members have inwardly and longitudinally convergent surfaces at their ends remote from said flange.

5. The protector of claim 4, wherein said compression members are compressed between said cylindrical member and said one joint half when said protector is telescoped longitudinally over said one joint half.

6. The protector of claim 5, wherein said compression members have ends adjacent said flange spaced from said flange.

7. The protector of claim 3, wherein said compression members are compressed between said cylindrical member and said one joint half when said protector is telescoped longitudinally over said one joint half.

8. The protector of claim 1, wherein said compression means comprises a cylindrical expander of smaller internal diameter than the external diameter of said one of said joint halves; and resilient compression members between said cylindrical member and said expander, said expander being radially expanded when said protector is positioned on said one of said joint halves.

9. The protector of claim 1, wherein said compression means include an inner cylindrical member, said first mentioned cylindrical member and said inner member having respectively internal and external annular compression flanges; and a resilient substance between said members and said compression flanges, said inner member having an internal flange engageable with the external shoulder of said one of said joint halves to limit telescopical movement of said inner member on said one of said joint halves; said substance being compressed to cause said protector member to forcibly engage said one of said joint halves when telescopical movement of said inner member on said one of said joint halves is arrested and the flange of said first mentioned cylindrical member is engaged by the external shoulder of said other of said joint halves and moves said first mentioned cylindrical member longitudinally relative to said inner member.

10. The protector of claim 9, wherein said inner member is provided with a plurality of spaced apertures through which said resilient substance may be compressed against said one half joint.

11. The protector of claim 1 wherein said compression means permit rotation of said tool joint relative to said protector when force tending to hold said protector against rotation exceeds a predetermined value.

12. The protector of claim 1, and a tubular body extending outwardly of said cylindrical member.

13. The protector of claim 12, wherein said body is integral with said cylindrical member.

14. The protector of claim 7; wherein said compression members have ends adjacent said flange spaced from said flange.

* * * * *